US009989895B2

(12) United States Patent
Inuzuka

(10) Patent No.: US 9,989,895 B2
(45) Date of Patent: Jun. 5, 2018

(54) IMAGE FORMING APPARATUS

(71) Applicant: CANON KABUSHIKI KAISHA, Tokyo (JP)

(72) Inventor: Tomoya Inuzuka, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/190,851

(22) Filed: Jun. 23, 2016

(65) Prior Publication Data

US 2016/0378025 A1 Dec. 29, 2016

(30) Foreign Application Priority Data

Jun. 26, 2015 (JP) ..... 2015-129121

(51) Int. Cl.
*G03G 15/00* (2006.01)
*G03G 15/16* (2006.01)
*G03G 15/01* (2006.01)

(52) U.S. Cl.
CPC ..... *G03G 15/1615* (2013.01); *G03G 15/0136* (2013.01)

(58) Field of Classification Search
CPC ..... G03G 15/1665
See application file for complete search history.

(56) References Cited

U.S. PATENT DOCUMENTS 6,101,360 A * 8/2000 Hara ..... G03G 15/162 399/302
2008/0095556 A1* 4/2008 Mochizuki ..... G03G 15/1605 399/308
2015/0063879 A1* 3/2015 Yuasa ..... G03G 15/0136 399/302

FOREIGN PATENT DOCUMENTS

| | | | |
|---|---|---|---|
| JP | 2005-091612 | A | 4/2005 |
| JP | 2008-203750 | A | 9/2008 |
| JP | 2008-268452 | A | 11/2008 |
| JP | 2008-268610 | A | 11/2008 |
| JP | 2009-122465 | A | 6/2009 |
| JP | 2011-033739 | A | 2/2011 |

* cited by examiner

*Primary Examiner* — David M Gray
*Assistant Examiner* — Michael Harrison
(74) *Attorney, Agent, or Firm* — Fitzpatrick, Cella, Harper & Scinto

(57) ABSTRACT

An image forming apparatus includes a movable endless belt, a first image bearing member, second image bearing members provided upstream of the first image bearing member with respect to a movement direction of the belt, a first transfer roller, second transfer rollers, an auxiliary roller provided upstream of a most upstream second transfer roller of the second transfer rollers with respect to the movement direction of the belt, and an executing portion capable of executing an operation in a full-color mode in a first roller arrangement and an operation in a monochromatic mode in a second roller arrangement.

18 Claims, 4 Drawing Sheets

IMAGE FORMING APPARATUS

FIELD OF THE INVENTION AND RELATED ART

The present invention relates to an image forming apparatus, such as a copying machine, a printer or a facsimile machine, using an electrophotographic type or an electrostatic recording type.

Conventionally, in the image forming apparatus using the electrophotographic type or the electrostatic recording type, a toner image is formed on an image bearing member, such as a drum-shaped or belt-shaped electrophotographic photosensitive member (photosensitive drum) or electrostatic recording dielectric member, by an appropriate image forming process. This toner image is directly transferred onto a recording material fed by a recording material carrying member (direct transfer type), or is once primary-transferred onto an intermediary transfer member and thereafter is secondary-transferred onto the recording material (intermediary transfer type). As the recording material carrying member or the intermediary transfer member, an endless belt has been frequently used. Further, as such an image forming apparatus, for example, there is a tandem(-type) image forming apparatus independently including image forming portions for forming toner images of colors of yellow, magenta, cyan and black.

The tandem image forming apparatus employing the intermediary transfer type in which the image is formed using the electrophotographic type will be further described as an example. This image forming apparatus includes, e.g., photosensitive drums each being a drum-shaped photosensitive member and an intermediary transfer belt which is a belt-shaped intermediary transfer member. The toner image formed on each photosensitive drum is primary-transferred onto the intermediary transfer belt by the action of a transfer member (primary transfer member) provided opposed to the photosensitive drum via the intermediary transfer belt. As the primary transfer member, a contact member which is contactable to an inner peripheral surface of the intermediary transfer belt and which is formed in a roller shape, a pad shape, a brush shape or a blade shape is used.

In some cases, such an image forming apparatus is capable of executing an operation in a full-color mode in which a full-color image can be outputted and an operation in a monochromatic mode in which a monochromatic image such as a black (single color) image can be outputted. In the monochromatic mode, in a color image forming portion which is not subjected to image formation, the primary transfer member is spaced from the photosensitive drum and the intermediary transfer belt is spaced from the photosensitive drum in some cases. As a result, consumption of process parts such as the photosensitive drums, the intermediary transfer belt and the primary transfer members are suppressed, so that it is possible to extend lifetimes of the parts.

However, during monochromatic mode, the primary transfer members for the colors do not support the intermediary transfer belt, and therefore the intermediary transfer belt causes slack, and the slack has the influence on the transfer of the toner images and leads to an image defect in some cases. Particularly, in recent years, a demand for printing on various media such as thick paper has increased, and when the toner image is secondary-transferred from the intermediary transfer belt onto the media such as the thick paper, there is a tendency that a tension of the intermediary transfer belt is liable to fluctuate and slack of the intermediary transfer belt is liable to generate.

On the other hand, Japanese Laid-Open Patent Application (JP-A) 2011-33739 discloses a method in which a roller for supporting the intermediary transfer belt during a monochromatic mode is provided upstream of and adjacent to a primary transfer portion for black image formation with respect to a rotational direction of the intermediary transfer belt.

Further, JP-A 2008-268452 discloses a method in which tension is increased during the monochromatic mode by changing a position of a spring for imparting the tension to the intermediary transfer belt.

As described above, when the intermediary transfer belt generates the slack during the monochromatic mode, for example, in a constitution in which the photosensitive drums are disposed above the intermediary transfer belt with respect to a vertical direction, the intermediary transfer belt rotates in some cases while contacting the primary transfer members for the colors. As a result, lifetimes of the primary transfer members and the intermediary transfer belt are shortened and feeding of the intermediary transfer belt becomes unstable in some cases. Further, for example, in the case where the primary transfer members are roller-shaped members (primary transfer rollers), abrasion (non-uniform abrasion with respect to a circumferential direction) generates on the surfaces of the rollers, and causes the image defect in some cases.

On the other hand, it would be considered that a countermeasure of increasing an amount (spacing amount) in which the primary transfer members are moved during the monochromatic mode from positions during a full-color mode is taken. However, in this method, a large space is needed for ensuring a distance (spacing distance) between the intermediary transfer belt and the primary transfer members, and therefore this method is disadvantageous from the viewpoint of downsizing of the image forming apparatus. Further, this method leads to an increase in time required to move the primary transfer members toward and away from the intermediary transfer belt, and thus is also disadvantageous from the viewpoint of productivity.

Further, in the method disclosed in JP-A 2011-33739 the method does not provide the countermeasure for ensuring the spacing distance between the intermediary transfer belt and the primary transfer members for the colors.

Further, in the method disclosed in JP-A 2008-268452, there is a possibility that the tension of the intermediary transfer belt during the toner image transfer is made unstable. Further, a plurality of tension conditions are required in some cases in order to meet slack due to disturbance in belt tension. For that reason, a complicated mechanism is required for tension setting, and thus leads to upsizing of the image forming apparatus and complication of the image forming apparatus.

SUMMARY OF THE INVENTION

According to an aspect of the present invention, there is provided an image forming apparatus comprising: a movable endless belt stretched by a plurality of stretching rollers; a first image bearing member which is provided above the belt at a position opposing the belt and on which a first toner image is formed; a plurality of second image bearing members which are provided above the belt at positions opposing the belt and on which second toner images are formed, respectively, the second image bearing members being arranged upstream of the first image bearing member with respect to a movement direction of the belt; a first transfer roller, urged toward the first image bearing member in contact with an inner peripheral surface of the belt, configured to form a first transfer nip; a plurality of second transfer rollers, urged toward the second image bearing members in contact with the inner peripheral surface of the belt, capable of forming a plurality of second transfer nips, the second transfer rollers being movable in a direction including a vertical direction; an auxiliary roller provided in contact with the inner peripheral surface of the belt at a position adjacent to and upstream of a most upstream second transfer roller among the plurality of second transfer rollers with respect to the movement direction of the belt, the auxiliary roller being movable in the direction including the vertical direction; and an executing portion capable of executing operations in first and second modes, wherein in the operation of the first mode, the second transfer rollers and the auxiliary roller are set in a first arrangement to form the first transfer nip and the second transfer nips and the second toner images and the first toner image are successively transferred from the second image bearing members and the first image bearing member, respectively, onto the belt, and in the operation in the second mode, the second transfer rollers and the auxiliary roller are set in a second arrangement to form the first nip and in a state in which the belt is spaced from the second image bearing members and in which the second transfer rollers are spaced from the belt, only the first toner image is transferred from the first image bearing member onto the belt to form an image, wherein each of positions of the second transfer rollers and the auxiliary roller with respect to the vertical direction is lower in the second arrangement than in the first arrangement, and wherein in the second arrangement, in a state in which the auxiliary roller contacts the inner peripheral surface of the belt, a position of a top of the auxiliary roller is higher than an uppermost position among positions of tops of the second transfer rollers with respect to the vertical direction.

Further features of the present invention will become apparent from the following description of exemplary embodiments with reference to the attached drawings.

DESCRIPTION OF THE EMBODIMENTS

An image forming apparatus according to the present invention will be described with reference to the drawings.

Embodiment 1

1. General Structure and Operation of Image Forming Apparatus

Figure 1:
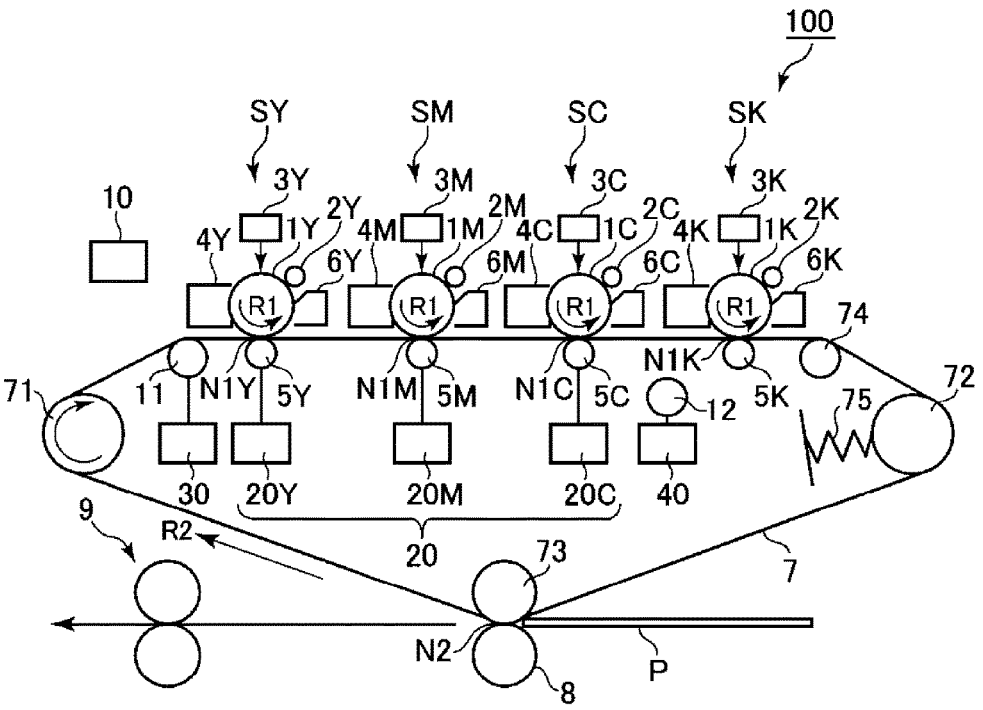
FIG. 1 is a schematic sectional view of an image forming apparatus (full-color mode).

FIG. 1 is a schematic sectional view of an image forming apparatus 100 in this embodiment according to the present invention.

The image forming apparatus 100 in this embodiment is a tandem(-type) color digital multi-function machine which is capable of forming a full-color image using an electrophotographic type and which employs an intermediary transfer type. The image forming apparatus 100 also has functions of a copying machine, a printer and a facsimile machine.

The image forming apparatus 100 includes, as a plurality of image forming portions (stations), first to fourth image forming portions SY, SM, SC and SK. The image forming portions SY, SM, SC and SK form images of colors of yellow (Y), magenta (M), cyan (C) and black (K), respectively.

Incidentally, as regards elements having substantially the same functions and constitutions provided for the image forming portions SY, SM, SC and SK, suffixes Y, M, C and K for representing the elements for associated colors, respectively, are omitted, and the elements will be collectively described. Further, the elements for the colors are distinguished by adding prefixes Y, M, C and K thereto in some cases. Further, the elements for the colors of yellow, magenta and cyan are collectively called those "for colors" in some cases.

In the image forming portion S, a photosensitive drum 1 which is a rotatable drum shaped photosensitive member as an image bearing member is provided. The photosensitive drum 1 is rotationally driven in an arrow R1 direction in the figure at a predetermined peripheral speed (process speed) by a driving mechanism (not shown) as a driving means. In the image forming portion S, at a periphery of the photosensitive drum 1, the following process devices are provided in the listed order along a rotational direction of the photosensitive drum 1. First, a charging roller 2 which is a roller shaped charging member as a charging means is disposed. Next, an exposure device (laser scanner) 3 as an exposure means is disposed. Next, a developing device 4 as a developing means is disposed. Next, a primary transfer roller 5 which is a roller shaped primary transfer member as a primary transfer means is disposed. Next, a drum cleaner 6 as a photosensitive member cleaning means is disposed.

A surface of the rotating photosensitive drum 1 is electrically charged substantially uniformly by the charging roller 2 to a predetermined polarity (negative in this embodiment) and a predetermined potential. The charged surface of the photosensitive drum 1 is subjected to irradiation with a laser beam on the basis of image information by the exposure device 3, so that an electrostatic latent image (electrostatic image) is formed on the surface of the photosensitive drum 1. The electrostatic latent image formed on the photosensitive drum 1 is developed (visualized) by depositing a toner as a developer on the photosensitive drum 1 by the developing device 4, so that a toner image is formed on the photosensitive drum 1. In this embodiment, the toner image is formed by image portion exposure and reverse development. That is, on an exposed portion on the photosensitive drum 1 where an absolute value of a potential is lowered by being exposed to light after being uniformly charged electrically, the toner charged to the same polarity (negative in this embodiment) as a charge polarity of the photosensitive drum 1 is deposited.

The image forming apparatus 100 includes an intermediary transfer belt 7 which is provided so as to oppose the photosensitive drums 1Y, 1M, 1C and 1K and which is constituted by an endless belt as an intermediary transfer member. In this embodiment, the intermediary transfer belt 7 is constituted by an endless elastic belt formed using a resin material or a rubber material. The intermediary transfer belt 7 is extended and stretched by, as a plurality of supporting rollers (stretching rollers), a driving roller 71, a tension roller 72, a secondary transfer opposite roller (inner secondary transfer roller) 73 and a transfer roller forming roller 74. Incidentally, in an inner peripheral surface side of the intermediary transfer belt 7, a first auxiliary roller 11 and a second auxiliary roller 12 which are changed in position depending on an image forming mode as described later are further provided as described later. These first and second auxiliary rollers are not included in the above-described plurality of supporting rollers. Further, these first and second auxiliary rollers will be specifically described later.

The intermediary transfer belt 7 is rotated (moved and circulated) in an arrow R2 direction in the figure at a peripheral speed corresponding to the peripheral speed of the photosensitive drum 1 by rotationally driving the driving roller 71 by a belt driving mechanism (not shown) as a driving means. The tension roller 72 is urged from the inner peripheral surface side toward an outer peripheral surface side of the intermediary transfer belt 7 by a spring 75 as an urging means, and imparts a predetermined tension (belt tension) to the intermediary transfer belt 7. The secondary transfer opposite roller 73 sandwiches the intermediary transfer belt 7 between itself and a secondary transfer roller 8 described later, and functions as an opposing member (opposing electrode) to the secondary transfer roller 8. The transfer surface forming roller 74 forms a transfer surface (a flat surface portion of the intermediary transfer belt 7 where the toner image is transferred from the photosensitive drum 1 onto the intermediary transfer belt 7) between itself and the first auxiliary roller 11 or the second auxiliary roller 12 depending on the image forming mode, as described later.

The above-described primary transfer rollers 5Y, 5M, 5C and 5K are provided so as to be contactable to the inner peripheral surface of the intermediary transfer belt 7 while opposing the photosensitive drums 1Y, 1M, 1C and 1K, respectively. Each of the primary transfer rollers 5 is pressed (urged) against the intermediary transfer belt 7 toward the associated photosensitive drum 1, and thus forms a primary transfer portion (primary transfer nip) N1 where the photosensitive drum 1 and the intermediary transfer belt 7 are in contact with each other. Further, in the outer peripheral surface side, at a position opposing the secondary transfer opposite roller 73, the secondary transfer roller (outer secondary transfer roller) 8 which is a roller-shaped secondary transfer member as a secondary transfer means is provided. The secondary transfer roller 8 is pressed (urged) against the intermediary transfer belt 7 toward the secondary transfer opposite roller 73, and thus forms a secondary transfer portion (secondary transfer nip) where the intermediary transfer belt 7 and the secondary transfer roller 8 are in contact with each other. Of the primary transfer rollers 5, the secondary transfer roller 8, the plurality of supporting rollers 71-74, the first auxiliary roller 11 and the second auxiliary roller 12, the rollers except that driving roller 71 are rotated with rotation of the intermediary transfer belt 7 in a state in which the rollers contact the inner peripheral surface of the intermediary transfer belt 7.

The toner image formed on each of the photosensitive drums 1 is electrostatically transferred (primary transferred) at the primary transfer portion N1 onto the intermediary transfer belt 7 by the action of the associated primary transfer roller 5. At this time, to the primary transfer roller 5, a primary transfer bias (primary transfer voltage) of an opposite polarity to a charge polarity (normal charge polarity) of the toner during development is applied. For example, during an operation in a full color mode, the color toner images of yellow, magenta, cyan and black formed on the photosensitive drums 1Y, 1M, 1C and 1K are successively transferred superposedly onto the intermediary transfer belt 7 at the primary transfer portions N1. The toner (primary transfer residual toner) remaining on each photosensitive drum 1 after the primary transfer step is removed and collected from the photosensitive drum 1 by the drum cleaner 6.

The toner images formed on the intermediary transfer belt 7 are electrostatically transferred (secondary-transferred) onto the recording material P (recording medium, transfer material, sheet) such as a recording sheet by the action of the secondary transfer roller 8. At this time, to the secondary transfer roller 8, a secondary transfer bias (secondary transfer voltage) of an opposite polarity to the normal charge polarity of the toner is applied. The recording material P is fed by a feeding device (not shown) to the secondary transfer portion N2 by being timed with the toners on the intermediary transfer belt 7. The toners (secondary transfer residual toners) remaining on the intermediary transfer belt 7 after the secondary transfer step are removed and collected from the intermediary transfer belt 7 by an intermediary transfer member cleaning means (not shown).

The recording material P on which the toner images are transferred is fed to a heating roller fixing device as a fixing means and is heated and pressed by the fixing device 9, so that the toner images are fixed on the recording material P. Thereafter, the recording material P is discharged (outputted) to an outside of an apparatus main assembly of the image forming apparatus 100.

Here, in this embodiment, in a normal operation (use) state of the image forming apparatus 100, the YMCK photosensitive drums 1Y, 1M, 1C and 1K are arranged substantially horizontally. In this state, the YMCK photosensitive drums 1Y, 1M, 1C and 1K are disposed above the intermediary transfer belt 7 with respect to the vertical direction.

2. Image Forming Mode

Next, the image forming mode in an operation of the image forming apparatus 100 will be described. In the following, "upstream" and "downstream" refer to those with respect to the rotational direction (movement direction).

The image forming apparatus 100 is capable of executing an operation in a full-color mode (first mode) in which a full color image can be formed and an operation in a monochromatic mode (second mode) in which a black single color) image can be formed. In the operation in the full-color mode, the images can be formed in all of the YMCK image forming portions SY, SM, SC and SK. On the other hand, in the operation in the monochromatic mode, the image can be formed in only the K image forming portion SK. Further, between the operation during the full-color mode and the operation during the monochromatic mode, a contact and separation state between the intermediary transfer belt 7 and the YMCK photosensitive drums 1Y, 1M, 1C and 1K is changed. That is, in the operation during the full-color mode, all of the YMCK photosensitive drums 1Y, 1M, 1C and 1K are contacted to the intermediary transfer belt 7. On the other hand, in the operation during the monochromatic mode, the YMC photosensitive drums 1Y, 1M and 1C and the intermediary transfer belt 7 are spaced from each other, and only the K photosensitive drum 1K is contacted to the intermediary transfer belt 7.

Figure 2:
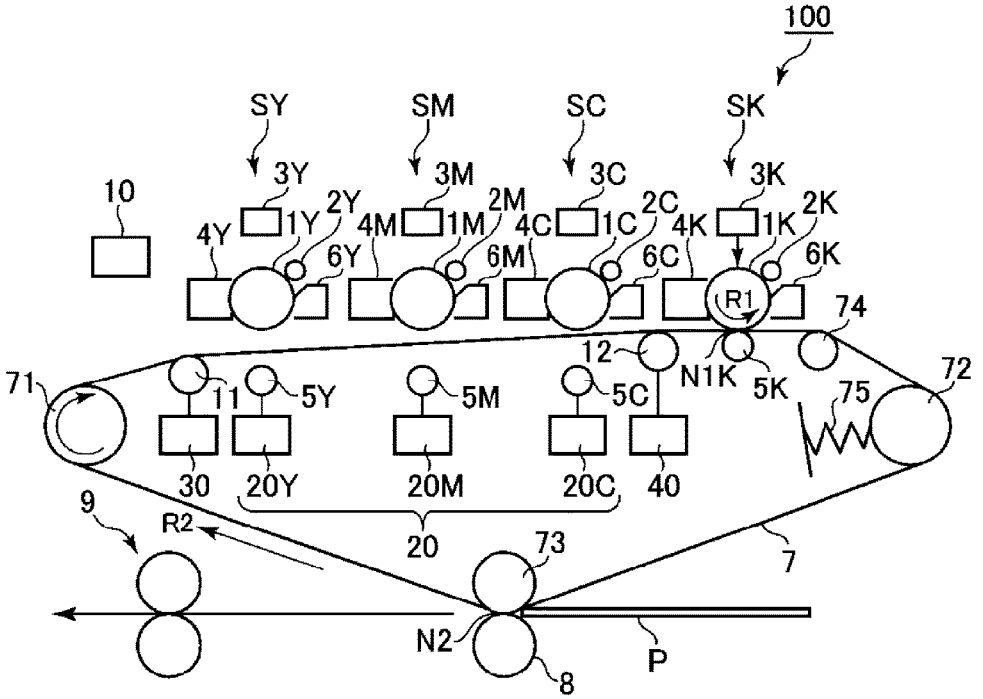
FIG. 2 is a schematic sectional view of the image forming apparatus (monochromatic mode).

FIG. 1 is a schematic sectional view of the image forming apparatus 100 in the operation during the full-color mode, and FIG. 2 is a schematic sectional view of the image forming apparatus in the operation during the monochromatic mode. The image forming apparatus 100 includes contact and separation mechanisms 20 (20Y, 20M and 20C) as moving means in order to change the contact and separation state of the intermediary transfer belt 7 relative to the YMCK photosensitive drums 1Y, 1M, 1C and 1K between the operations during the full-color mode and during the monochromatic mode. As shown in FIG. 1, in the operation during the full-color mode, the contact and separation mechanisms 20 cause the YMC primary transfer rollers 5Y, 5M and 5C to press-contact the intermediary transfer belt 7 toward the YMC photosensitive drums 1Y, 1M and 1C, respectively. At this time, positions of the YMC primary transfer rollers are "contact positions". On the other hand, as shown in FIG. 2, in the operation during the monochromatic mode, the contact and separation mechanisms 20 space the YMC primary transfer rollers 5Y, 5M and 5C from the intermediary transfer belt 7, and thus space the intermediary transfer belt 7 from the YMC photosensitive drums 1Y, 1M and 1C. At this time, positions of the YMC primary transfer rollers 5Y, 5M and 5C are "spaced positions". In this embodiment, the contact and separation mechanisms 20 move the YMC primary transfer rollers 5Y, 5M and 5C between higher contact positions (closer to the photosensitive drums 1) and lower spaced positions (remoter from the photosensitive drums 1) along the vertical direction. In this embodiment, in both of the operation during the full-color mode and the operation during the monochromatic mode, the K primary transfer roller 5 is press-contacted to the intermediary transfer belt 7 toward the K photosensitive drum 1K.

Further, in the inner peripheral surface side of the intermediary transfer belt 7, the first auxiliary roller 11 as an auxiliary member is provided in a side upstream of the Y primary transfer roller 1Y and downstream of the driving roller 71 with respect to the rotational (movement) direction of the intermediary transfer belt 7. Further, in the inner peripheral surface side of the intermediary transfer belt 7, the second auxiliary roller 12 as another auxiliary member is provided in a side upstream of the K primary transfer roller 5K and downstream of the C primary transfer roller 5C with respect to the rotational direction of the intermediary transfer belt 7.

Further, the image forming apparatus 100 includes a first displacing mechanism 30 as a displacing means for changing (displacing) a position of the first auxiliary roller 11 between the operation during the full-color mode and the operation during the monochromatic mode. The first displacing mechanism 30 displaces the first auxiliary roller 11 along a substantially vertical direction (movement directions of the YMC primary transfer rollers 5Y, 5M and 5C by the contact and separation mechanisms 20). As shown in FIG. 1, in the operation during the full-color mode, the first displacing mechanism 30 disposes the first auxiliary roller 11 at a higher position (position closer to the photosensitive drum 1) with respect to the vertical direction. On the other hand, as shown in FIG. 2, in the operation during the monochromatic mode, the first displacing mechanism 30 disposes the first auxiliary roller 11 at a lower position (position remoter from the photosensitive drum 1) with respect to the vertical direction. In this embodiment, the first auxiliary roller 11 contacts the inner peripheral surface of the intermediary transfer belt 7 (i.e., supports the intermediary transfer belt 7) in either of the operation during the full-color mode and the operation during the monochromatic mode. Here, positions (heights) of the YMCK primary transfer portions N1Y, N1M, N1C and N1K are reference positions (reference heights)=0 in the operation during the full-color mode. In this embodiment, the position (height) of the first auxiliary roller 11 in the operation during the full-color mode is the reference position (reference height).

Incidentally, the position (height) of the first auxiliary roller 11 is represented by a position at a portion closest to the intermediary transfer belt 7 (the photosensitive drum 1) with respect to a movement direction of the first auxiliary roller 11 (i.e., the vertical direction in this embodiment). This is true for the second auxiliary roller 12 and the respective primary transfer rollers 5. The above-described reference positions (reference heights) are substantially the same as the positions (heights) of the YMCK primary transfer rollers 5Y, 5M, 5C and 5K in the operation during the full-color mode.

Further, the image forming apparatus 100 includes a second displacing mechanism 40 as a displacing means for changing (displacing) a position of the second auxiliary roller 12 between the operation during the full-color mode and the operation during the monochromatic mode. The second displacing mechanism 40 displaces the second auxiliary roller 12 along a substantially vertical direction (movement directions of the YMC primary transfer rollers 5Y, 5M and 5C by the contact and separation mechanisms 20). As shown in FIG. 1, in the operation during the full-color mode, the second displacing mechanism 40 disposes the second auxiliary roller 12 at a lower position (position remote from the photosensitive drum 1) with respect to the vertical direction, and thus spaces the second auxiliary roller 12 from the inner peripheral surface of the intermediary transfer belt 7. On the other hand, as shown in FIG. 2, in the operation during the monochromatic mode, the second displacing mechanism 40 disposes the second auxiliary roller 12 at a higher position (position closer to the photosensitive drum 1) with respect to the vertical direction. As a result, the second displacing mechanism 40 causes the second auxiliary roller 12 to contact the inner peripheral surface of the intermediary transfer belt 7 (i.e., to support the intermediary transfer belt 7) in either of the operation during the full-color mode and the operation during the monochromatic mode. In this embodiment, the position (height) of the second auxiliary roller 12 in the operation during the monochromatic mode is the reference position (reference height).

The contact and separation mechanisms 20, the first displacing mechanism 30 and the second displacing mechanism 40 are controlled by a control circuit 10 provided in the image forming apparatus 100. The control circuit 10 is constituted by including a computation control element and a storing element, and controls operations of respective portions of the image forming apparatus 100. The control circuit 10 functions as an executing portion capable of executing the operation in the full-color mode and the operation in the monochromatic mode by switching the contact and separation state between the intermediary transfer belt 7 and the photosensitive drums 1Y, 1M, 1C and 1K by the contact and separation mechanisms 20, the first displacing mechanism 30 and the second displacing mechanism 40.

Thus, in this embodiment, in the operation during the monochromatic mode, the intermediary transfer belt 7 is spaced from the YMC photosensitive drums 1Y, 1M and 1C by changing the positions (heights) of the above-described rollers. As a result, it is possible to suppress consumption of the YMC photosensitive drums 1Y, 1M and 1C, the YMC primary transfer rollers 5Y, 5M and 5C, and the intermediary transfer belt 7 and thus lifetime extension of the parts can be realized.

In the operation during the full-color mode, a transfer surface is formed from the first auxiliary roller 11 to the transfer surface forming roller 74, and the intermediary transfer belt 7 is supported by the YMCK primary transfer rollers 5Y, 5M, 5C and 5K disposed between the rollers 11 and 74. On the other hand, in the operation during the monochromatic mode, by the above-described change in position (height) of the rollers, the transfer surface is formed from the second auxiliary roller 12 to the transfer surface forming roller 74, and the intermediary transfer belt 7 is supported by the K primary transfer roller 5K between the rollers 12 and 74. In this embodiment, in the operation during the monochromatic mode, the position (height) of the first auxiliary roller 11 is set so that the intermediary transfer belt 7 does not contact the YMC primary transfer rollers 5Y, 5M and 5C between the first auxiliary roller 11 and the second auxiliary roller 12. This will be described further in detail.

3. Slack of Intermediary Transfer Belt

As described above, in the operation during the monochromatic mode, the number of the rollers supporting the intermediary transfer belt 7 decreases, and therefore, tension of the intermediary transfer belt 7 decreases and thus there is a liability of generation of slack of the intermediary transfer belt 7.

Figure 4:
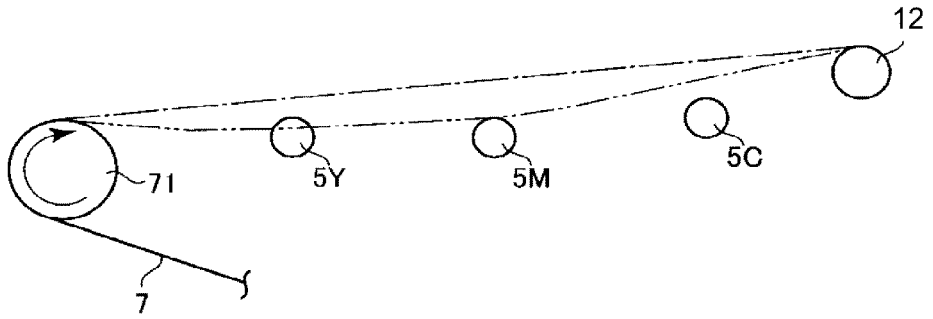
FIG. 4 is a schematic view for illustrating slack of a belt.

FIG. 4 schematically shows a state of sag due to slack of the intermediary transfer belt 7 in the operation during the monochromatic mode in the case where the first auxiliary roller 11 in this embodiment is not provided. In the case where the slack of the intermediary transfer belt 7 is not generated between the driving roller 71 and the second auxiliary roller 12, the intermediary transfer belt 7 is in a position indicated by a chain line in FIG. 4, and therefore, does not contact the spaced YMC primary transfer rollers 5Y, 5M and 5C. However, in actuality, the intermediary transfer belt 7 slacks between the driving roller 71 and the second auxiliary roller 12 and thus is in a position indicated by a chain double-dashed line in FIG. 4 in some cases. In the cases, the intermediary transfer belt 7 contacts one or a plurality of the YMC primary transfer rollers 5Y, 5M and 5C, so that abrasion (non-uniform abrasion with respect to a circumferential direction) of the surface(s) of the primary transfer roller(s) generates in some instances. Further, in some cases, lifetimes of the YMC primary transfer rollers are shortened or feeding of the intermediary transfer belt 7 becomes unstable.

Table 1 shows a relationship between a maximum of sagging (slack) amount of the intermediary transfer belt 7 in the operation during the monochromatic mode and spacing distances of the YMC primary transfer rollers 5Y, 5M and 5C from the intermediary transfer belt 7 in the case where the first auxiliary roller 11 in this embodiment is not provided. Here, the sagging amount means a distance between the chain line and the chain double-dashed line immediately on or above the associated primary transfer roller 5Y, 5M or 5C. Further, the spacing distance means a distance from each of the YMC primary transfer rollers 5Y, 5M and 5C to the chain line immediately above the associated primary transfer roller in FIG. 4. The positions of the YMC primary transfer rollers in the operation during the monochromatic mode are the same as those in this embodiment.

TABLE 1

| | Y | M | C |
|---|---|---|---|
| Sagging amount*1 (mm) | 2.15 | 6.46 | 2.48 |
| Spacing distance*2 (mm) | 1.55 | 4.33 | 5.44 |

*1"Sagging amount" is that of the belt.
*2"Spacing distance" is that between the roller and the belt.

As is understood from Table 1, particularly immediately above the Y primary transfer roller 5Y and the M primary transfer roller 5M, the sagging amount exceeds the spacing distance, and therefore, there is a high possibility that the intermediary transfer belt 7 and the YM primary transfer rollers 5Y and 5M are in contact with each other.

4. Position of First Arrangement in Operation During Monochromatic Mode

Figure 3:
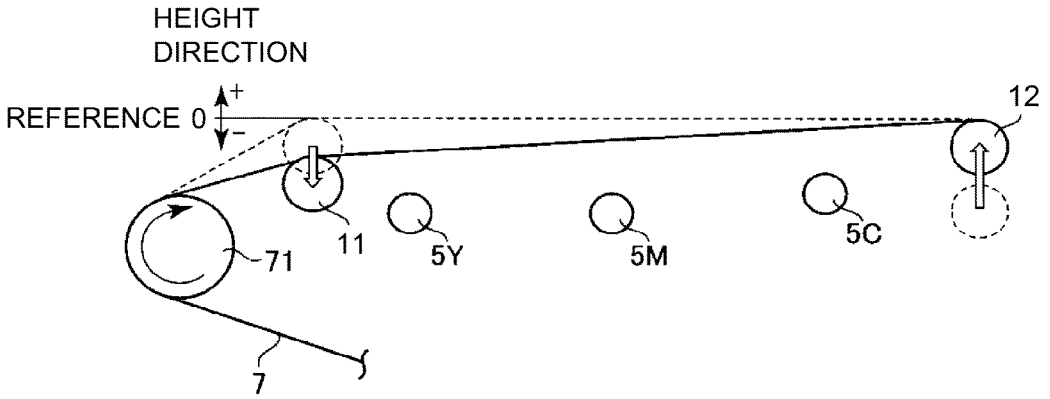
FIG. 3 is a schematic view showing a height relationship among rollers.

FIG. 3 is a schematic view showing an arrangement of the first auxiliary roller 11, the YMC primary transfer rollers 5Y, 5M and 5C, and the second auxiliary roller 12 in the operation during the monochromatic mode in this embodiment.

In this embodiment, amounts (spacing amounts) in which the YMC primary transfer rollers 5Y, 5M and 5C are moved in the operation during the monochromatic mode from positions of those in the operation during the full-color mode, i.e., displacing amounts from the reference positions (reference heights) are as follows. The Y primary transfer roller 5Y is 10.0 mm, the M primary transfer roller 5M is 10.0 mm and the C primary transfer roller 5C is 9.10 mm. That is, the positions (heights) of the YMC primary transfer rollers 5Y, 5M and 5C are as follows with respect to the reference position (reference height)=0. The Y primary transfer roller 5Y is −10.0 mm, the M primary transfer roller 5M is −10.0 mm, and the C primary transfer roller 5C is −9.10 mm.

Further, in this embodiment, the position (height) of the first auxiliary roller 11 in the operation during the monochromatic mode is −6.2 mm with respect to the reference position (reference height)=0. That is, in this embodiment, movement amounts of the YMC primary transfer rollers 5Y, 5M and 5C from the contact positions to the spaced positions are larger than a movement amount of the first auxiliary roller 11 from the position of execution of the operation during the full-color mode to the position of execution of the operation during the monochromatic mode.

Thus, in this embodiment, in the operation during the monochromatic mode, the first auxiliary roller 11 is contacted to the intermediary transfer belt 7 at the position of −6.2 mm with respect to a predetermined position (height), i.e., the reference position (reference height)=0. At this position, the intermediary transfer belt 7 is supported by the first auxiliary roller 11. That is, in this embodiment, in the operation during the monochromatic mode, the position (height) of the first auxiliary roller 11 is made higher than the positions (heights) of the YMC primary transfer rollers 5Y, 5M and 5C and is made lower than that in the operation during the full-color mode. As a result, the spacing distances of the YMC primary transfer rollers 5Y, 5M and 5C from the intermediary transfer belt 7 are increased, so that contact of the YMC primary transfer rollers 5Y, 5M and 5C with the intermediary transfer belt 7 is suppressed.

In this embodiment, it is possible to ensure the spacing distances of the YMC primary transfer rollers 5Y, 5M and 5C from the intermediary transfer belt 7 in the operation during the monochromatic mode. As a result, in the operation during the monochromatic mode, the YMC primary transfer rollers 5Y, 5M and 5C are spaced from the intermediary transfer belt 7 and it is possible to suppress contact of the intermediary transfer belt 7 with the YMC primary transfer rollers 5Y, 5M and 5C. For that reason, abrasion of the surfaces of the YMC primary transfer rollers 5Y, 5M and 5C due to the contact with the intermediary transfer belt 7 can be suppressed. Further, it is possible to suppress phenomenon that lifetimes of the YMC primary transfer rollers are shortened or feeding of the intermediary transfer belt 7 becomes unstable.

Table 2 shows a relationship between a maximum of sagging (slack) amount of the intermediary transfer belt 7 in the operation during the monochromatic mode and spacing distances of the YMC primary transfer rollers 5Y, 5M and 5C from the intermediary transfer belt 7 in this embodiment. Here, the sagging amount means a distance of downward movement of the intermediary transfer belt 7 from a position indicated by a solid line in FIG. 3 immediately above the associated primary transfer roller 5Y, 5M or 5C. Further, the spacing distance means a distance from each of the YMC primary transfer rollers 5Y, 5M and 5C to the position of the intermediary transfer belt 7 indicated by the solid line in FIG. 3 immediately above the associated primary transfer roller.

TABLE 2

| | Y | M | C |
|---|---|---|---|
| Sagging amount*1 (mm) | 2.21 | 3.47 | 2.48 |
| Spacing distance*2 (mm) | 4.43 | 6.05 | 6.00 |

*1"Sagging amount" is that of the belt.
*2"Spacing distance" is that between the roller and the belt.

As is understood from Table 2, in this embodiment, even at the position of the Y primary transfer roller 5Y closest to the sagged (slacked) intermediary transfer belt 7, it is possible to ensure the spacing distance of 2.22 mm from the intermediary transfer belt 7. At the positions of the MC primary transfer rollers 5M and 5C, it is possible to ensure spacing distances larger than the spacing distance of the Y primary transfer roller 5Y. For that reason, it is possible to surface contact of the intermediary transfer belt 7 with the YMC primary transfer rollers 5Y, 5M and 5C in the operation during the monochromatic mode.

5. Displacing Means

Next, the first displacing mechanism 30 for displacing the first auxiliary roller 11 in this embodiment will be described.

In this embodiment, in the operation during the full-color mode, the first auxiliary roller 11 is required to be disposed at the same height (reference height) (level) as the Y primary transfer portion N1Y in order to form the Y primary transfer portion N1Y. On the other hand, in the operation during the monochromatic mode, the first auxiliary roller 11 is required to be displaced to a position lower than the reference height so that the YMC photosensitive drums 1Y, 1M and 1C and the intermediary transfer belt 7 are not in contact with each other. Further, in the operation during the monochromatic mode, the first auxiliary roller 11 is required to be displaced to a proper height so that the first auxiliary roller 11 can contact (support) the intermediary transfer belt 7 at a proper position.

Figure 5:
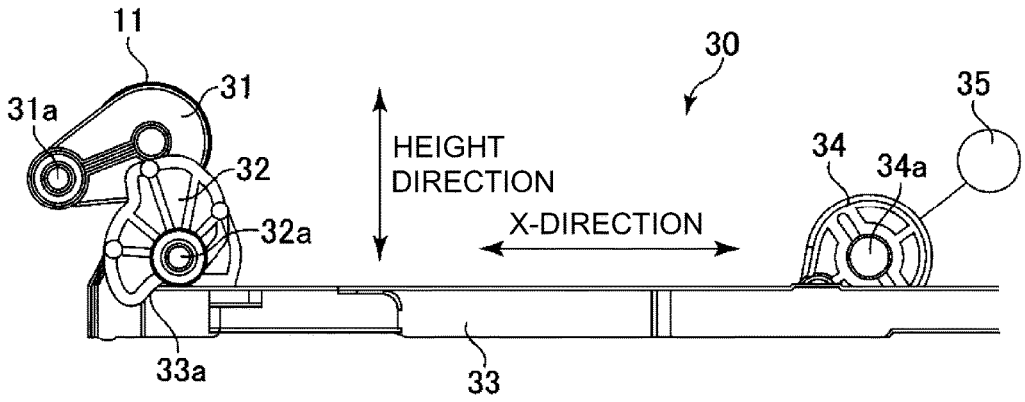
FIG. 5 is a schematic side view of a displacing mechanism.

FIG. 5 is a schematic side view of the first displacing mechanism 30 in this embodiment. The first auxiliary roller 11 is rotatably supported by a bearing member 31 swingable (rotatable) about a rotation shaft 31*a*. The bearing member 31 contacts an eccentric cam 32 rotatable about a rotation shaft 32*a* and a position thereof with respect to a height direction can be determined by a rotational phase of the eccentric cam 32. Further, a slide link 33 as a driving force transmitting member for transmitting a driving force to the eccentric cam 32 is provided. The slide link 33 can be linearly moved (reciprocated) in an arrow X direction in the figure by a link member 34 as a drive input member rotatable about a rotation shaft 34*a* by a driving motor 35 as a driving source.

The eccentric cam 32 contacts an abutting portion 33*a* of the slide link 33 and is rotated about the rotation shaft 32*a* by being subjected to displacement of the slide link 33 in the arrow X direction in the figure. The position of the slide link 33 with respect to the arrow X direction in the figure can be detected by an unshown home position (HP) detecting means. The driving motor 35 is excited after being driven by the number of predetermined pulses from HP detection timing, and thus determines the position of the slide link 33 in the arrow X direction, so that it is possible to finally hold the first auxiliary roller 11 at a predetermined height.

Figure 6:
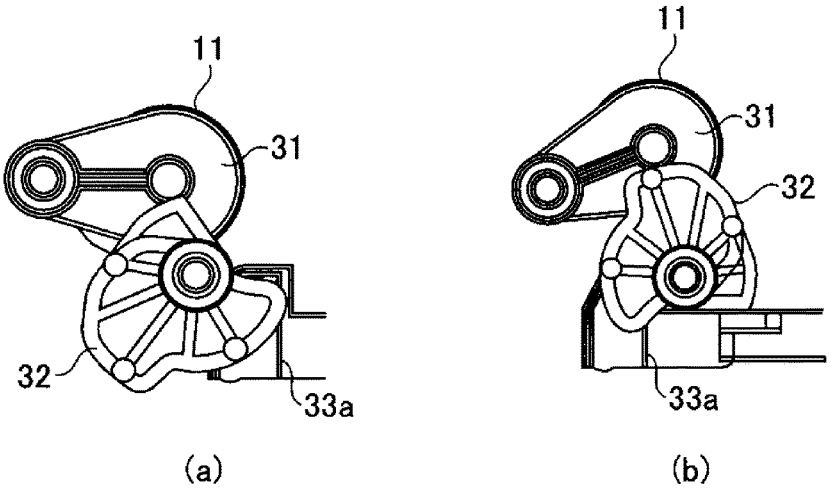
In FIG. 6, (a) and (b) are schematic side views for illustrating an operation of an eccentric cam in the displacing mechanism.

Thus, the height of the first auxiliary roller 11 can be determined by rotation and stop of rotation of the driving motor 35. In FIG. 6, (a) and (b) show states of the eccentric cam 32, the first auxiliary roller 11 and the like in the operation during the monochromatic mode and the operation during the full-color mode, respectively.

In this embodiment, the first displacing mechanism 30 for displacing the first auxiliary roller 11 is constituted by the bearing member 31, the eccentric cam 32, the slide link 33, the link member 34, the driving motor 35 and the like which are described above.

In this embodiment, also the second displacing mechanism 40 for displacing the second auxiliary roller 12 has substantially the same constitution as the constitution of the above-described first displacing mechanism 30. Further, in this embodiment, also the contact and separation mechanisms 20 (20Y, 20M and 20C) for the YMC primary transfer rollers 5Y, 5M and 5C have substantially the same constitutions as the constitution of the above-described first displacing mechanism 30. However, in the contact and separation mechanisms 20 (20Y, 20M and 20C), bearing members for the YMC primary transfer rollers 5Y, 5M and 5C are supported by holders via springs as urging means, and the holders are displaced by the eccentric cams. As a result, in the operation during the full-color mode, the YMC primary transfer rollers 5Y, 5M and 5C are pressed (urged) against the intermediary transfer belt 7 toward the YMC photosensitive drums 1Y, 1M and 1C, respectively, with predetermined pressing (urging) forces. Further, in this embodiment, commonality of the above-described slide link 33 and driving motor 35 is provided among the first displacing mechanism 30, the second displacing mechanism 40 and the contact and separation mechanisms 20 (20Y, 20M and 20C). Further, cam profiles of the eccentric cams of the first displacing mechanism 30, the second displacing mechanism 40 and the contact and separation mechanisms 20 (20Y, 20M and 20C) are set so as to provide the above-described positions of the respective rollers in the operation during the full-color mode and the operation during the monochromatic mode. Thus, commonality of at least a part of the elements is realized among the first displacing mechanism 30, the second displacing mechanism 40 and the contact and separation mechanisms 20 (20Y, 20M and 20C), so that simplification of the constitution of the image forming apparatus can be realized.

As described above, the image forming apparatus 100 in this embodiment includes the rotatable endless belt 7 extended around the plurality of supporting rollers 71-74.

Further, the image forming apparatus 100 includes the first image bearing member 1K and the second image bearing members 1Y, 1M and 1C (which are represented by the Y image bearing member 1Y) which are arranged in the rotational direction of the belt 7 and which are contactable to the belt 7. Further, the image forming apparatus 100 includes the first contact member 5K and the second contact member 5Y which are provided correspondingly to the first image bearing member 1K and the second image bearing member 1Y, respectively, and which are contactable to the inner peripheral surface of the belt 7. Further, the image forming apparatus 100 includes the moving means 20 for moving the second contact member 5Y between the contact position of the second contact member 5Y with the belt 7 and the spaced position of the second contact member 5Y from the inner peripheral surface of the belt 7. Further, the image forming apparatus 100 includes the executing portion 10 capable of executing the operation in a first mode (full-color mode) and the operation in a second mode (monochromatic mode). In the operation in the first mode, in a state in which the first and second contact members contact the belt 7 and in which the first and second image bearing members contact the belt 7, the toner images are transferred from the first and second image bearing members, respectively, onto the belt. In the operation in the second mode, in a state in which the first contact member and the first image bearing member contact the belt and in which the second contact member is spaced from the belt and the belt is spaced from the second image bearing member, the toner image is transferred from the first image bearing member onto the belt. The image forming apparatus 100 includes the auxiliary member 11 which is disposed in an opposite side from the first image bearing member 1K relative to the second image bearing member 1Y with respect to the rotational direction of the belt 7 and which contacts the belt 7 at least during the execution of the operation in the second mode. Further, the contact position between the belt 8 and the auxiliary member 11 during the execution of the operation in the second mode is closer to the contact position of the second contact member 5 than to the spaced position of the second contact member 5 with respect to a direction of movement of the second contact member 5 between the contact position and the spaced position.

Particularly, in this embodiment, the auxiliary member 11 is disposed at the inner peripheral surface side of the belt 7. Further, particularly, in this embodiment, the image forming apparatus 100 include the displacing means 30 for moving the auxiliary member 11 between the position of the auxiliary member 11 during the execution of the operation in the first mode and the position of the auxiliary member 11 during the execution of the operation in the second mode, and the auxiliary member 11 contacts the belt 7 both during the execution of the operation in the first mode and during the execution of the operation in the second mode. At this time, in this embodiment, the contact position between the auxiliary member 11 and the belt 7 during the execution of the operation in the second mode is as follows. That is, with respect to the movement direction of the second contact member 5Y between the contact position and the spaced position, the contact position between the auxiliary member 11 and the belt 7 is closer to the contact position of the second contact member 5Y than to the spaced position of the second contact member 5Y and is closer to the spaced position than to the contact position between the auxiliary member 11 and the belt 7 during the execution of the operation in the first mode. Further, in this embodiment, the auxiliary member 11 is disposed between the second image bearing member 1Y and the supporting roller 71, of the plurality of supporting rollers 71-74, disposed adjacent to the auxiliary member 11 at an opposite side from the first image bearing member 1K relative to the second image bearing member 1Y with respect to the rotational direction of the belt 7. Specifically, in this embodiment, with respect to the rotational direction of the belt 7, the auxiliary member 11 is disposed at the opposite side from the first image bearing member 1K relative to the second image bearing member 1Y disposed remotest among the second image bearing members 1Y, 1M and 1C from the first image bearing member 1K. Further, the image forming apparatus 100 includes another auxiliary member 12 disposed at the inner peripheral surface side of the belt 7 between the first image bearing member 1K and the second image bearing member 1C adjacent to the first image bearing member 1K with respect to the rotational direction of the belt 7. The other auxiliary member 12 contacts the belt 7 at least during the execution of the operation in the second mode.

As described above, the height of the first auxiliary roller 11 is made higher than the heights of the YMC primary transfer rollers 5Y, 5M and 5C in the operation during the monochromatic mode and is made lower than the heights of the YMC primary transfer rollers 5Y, 5M and 5C in the operation during the full-color mode. As a result, it is possible to suppress the contact of the intermediary transfer belt 7 with the primary transfer rollers 5Y, 5M and 5C due to the slack of the intermediary transfer belt 7 in the operation during the monochromatic mode while suppressing upsizing, complication and a lowering in productivity of the image forming apparatus. For that reason, it is possible to suppress the abrasion of the surfaces of the YMC primary transfer rollers 5Y, 5M and 5K. Further, it is possible to suppress phenomena that the lifetimes of the YMC primary transfer rollers 5Y, 5M and 5C and that the feeding of the intermediary transfer belt 7 becomes unstable.

Other Embodiments

The present invention was described above based on the specific embodiment, but is not limited to the above-described embodiment.

For example, in the above-described embodiment, the first auxiliary roller provided upstream of the most upstream primary transfer roller for the color with respect to the rotational direction of the intermediary transfer belt is displaced between during the operation in the full-color mode and during the operation in the monochromatic mode, but is not limited thereto. The first auxiliary roller may only be required to contact (support) the intermediary transfer belt at a predetermined position at least in the operation during the monochromatic mode. For example, the first auxiliary roller may also be fixedly disposed at the position in the operation during the monochromatic mode in the above-described embodiment. Further, in the above-described embodiment, the second auxiliary roller provided downstream of the most downstream primary transfer roller for the color with respect to the rotational direction of the intermediary transfer belt is displaced between during the operation in the full-color mode and during the operation in the monochromatic mode, but is not limited thereto. The second auxiliary roller may only be required to contact (support) the intermediary transfer belt at a predetermined position at least in the operation during the monochromatic mode, but may also contact the intermediary transfer belt in the operations in both of the full-color mode and the monochromatic mode. For example, the second auxiliary roller may also be fixedly disposed at the position in the operation during the full-color mode in the above-described embodiment.

Further, in the above-described embodiment, the first auxiliary roller is disposed at the position higher than the positions of all of the primary transfer rollers for the colors in the operation during the monochromatic mode, but is not limited thereto. As described above, the spacing distance from the intermediary transfer belt varies depending on the primary transfer rollers for the colors in some cases. The first auxiliary roller may only be required that the intermediary transfer belt can be prevented from contacting the primary transfer rollers for the colors in the operation during the monochromatic mode on the basis of the movement amount (spacing amount) of the primary transfer rollers for the colors in the operation during the monochromatic mode from those in the operation during the full-color mode. Accordingly, the position of the first auxiliary roller in the operation during the monochromatic mode may only be required to be higher than at least one of the positions of the primary transfer rollers for the colors, and may also be lower than one or a plurality of positions of the primary transfer rollers for the colors. For example, the first auxiliary roller may also be disposed at the position lower than the position of the primary transfer roller for the color (the C primary transfer roller in the above-described embodiment) remotest from the first auxiliary roller in the operation during the monochromatic mode (and may also be disposed at the position higher than the positions of other primary transfer rollers for the colors).

Further, in the above-described embodiment, the first auxiliary roller was disposed upstream of the most upstream primary transfer roller for the color with respect to the rotational direction of the intermediary transfer belt, but is not limited thereto. For example, in the above-described embodiment, the first auxiliary roller may also be disposed between the Y primary transfer roller and the M primary transfer roller or between the M primary transfer roller and the C primary transfer roller.

Further, in the above-described embodiment, the image forming apparatus was constituted so that the photosensitive drums were disposed above the intermediary transfer belt. In the case of such a constitution, the intermediary transfer belt which is not supported by the primary transfer rollers for the colors sags (slacks) downwardly by gravitation in the operation during the monochromatic mode, and is liable to contact the primary transfer rollers for the colors, and therefore, an effect obtained by applying the present invention is particularly remarkable. However, for example, in the case where vibration is generated on the intermediary transfer belt by shock when the recording material runs against the secondary transfer portion, the vibrated intermediary transfer belt is liable to contact the primary transfer rollers irrespective of an arrangement relationship between the intermediary transfer belt and the photosensitive drums with respect to the direction of gravitation. Accordingly, for example, even in the constitution in which the photosensitive drums are disposed below the intermediary transfer belt with respect to the vertical direction, the present invention is applicable, and therefore it is possible to suppress the contact of the vibrated intermediary transfer belt with the primary transfer rollers for the colors in the operation during the monochromatic mode. Similarly, for example, even in a constitution in which the photosensitive drums and the intermediary transfer belt are juxtaposed in a horizontal direction, the present invention is applicable, and therefore, it is possible to suppress contact of the intermediary transfer belt with the primary transfer rollers for the colors in the operation during the monochromatic mode.

Further, in the above-described embodiment, the first auxiliary roller was disposed in the inner peripheral surface side of the intermediary transfer belt, but is not limited thereto. For example, as described above, in the constitution in which the photosensitive drums are disposed below the intermediary transfer belt with respect to the vertical direction, a first auxiliary roller similar to the first auxiliary roller in the above-described embodiment can be provided in the outer peripheral surface side of the intermediary transfer belt. In this case, the first auxiliary roller may only be required to contact the intermediary transfer belt only in the operation during the monochromatic mode and may only be required to be spaced from the intermediary transfer belt toward the photosensitive drums in the operation during the full-color mode. As a result, in the operation during the monochromatic mode, it is possible to suppress not only the contact of the vibrated intermediary transfer belt with the primary transfer rollers for the colors but also the contact of the intermediary transfer belt with the photosensitive drums for the colors, in the operation during the monochromatic mode.

Figure 7:
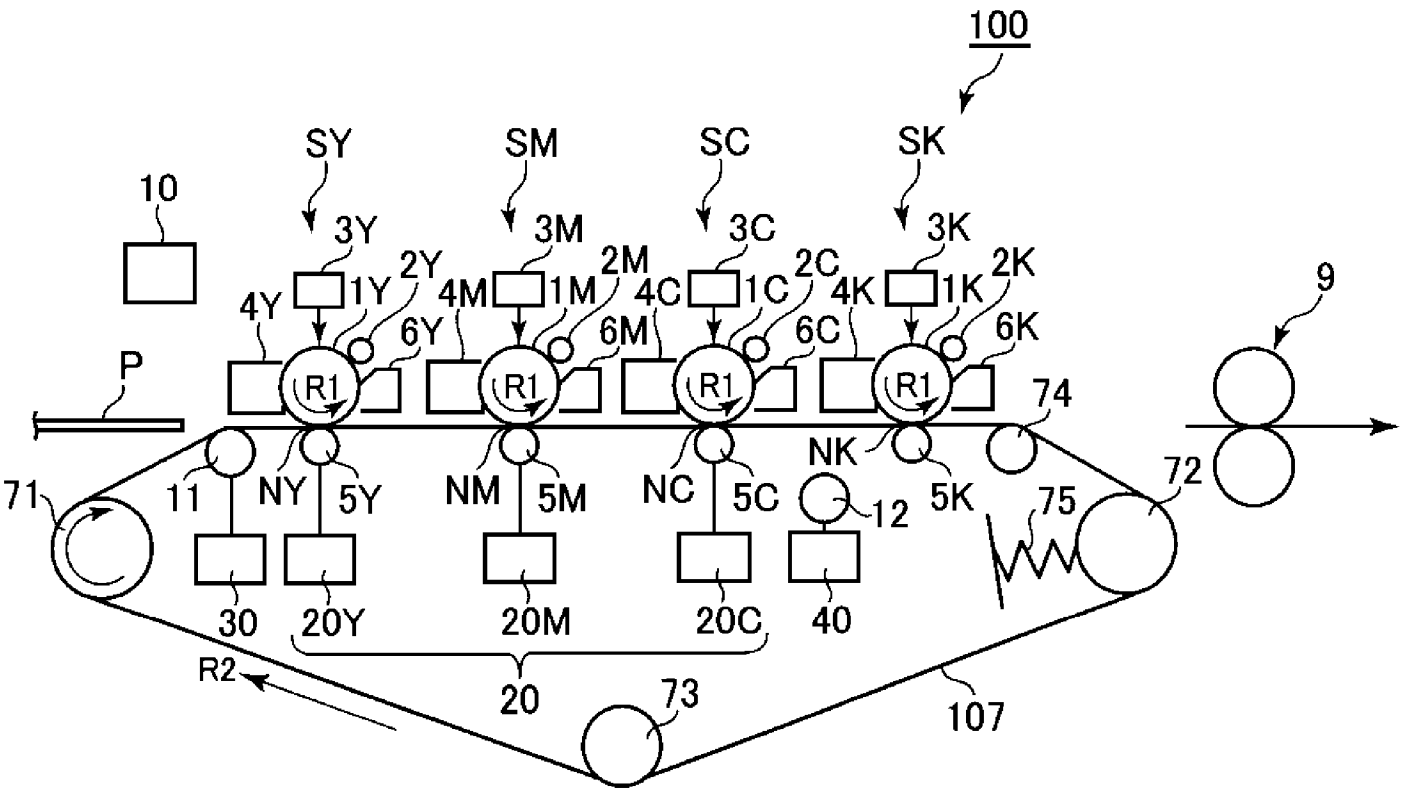
FIG. 7 is a schematic sectional view of another example of the image forming apparatus.

In the above-described embodiment, the image forming apparatus of the intermediate transfer type was described as an example, but the present invention is also applicable to an image forming apparatus of a direct transfer type. FIG. 7 is a schematic sectional view of a principal part of the image forming apparatus of the direct transfer type. In FIG. 7, elements having the same or corresponding functions or constitutions are represented by the same reference numerals or symbols. The image forming apparatus 100 in FIG. 7 includes, in place of the intermediary transfer belt 7, a recording material carrying belt 107 constituted by an endless belt as a recording material carrying member. In the image forming apparatus 100 in FIG. 7, each of toner images formed on the photosensitive drums 1 at the image forming portions S is transferred at the transfer portions N onto the recording material P carried and fed on the recording material carrying belt 107. Also in such an image forming apparatus 100 of the direct transfer type, in the case where the image forming apparatus is capable of executing the operation in the full-color mode and the operation in the monochromatic mode, a problem similar to the problem in the case of the image forming apparatus of the intermediary transfer type in the above-described embodiment can generate. Accordingly, the present invention is also applicable to the image forming apparatus of the direct transfer type, and effects similar to those in the above-described embodiment can be obtained.

Further, the rotational direction of the belt and the arrangement of the image forming portions for the respective colors are not limited to those in the above-described embodiment. For example, the image forming apparatus may also have a constitution in which the order of the arrangement of the image forming portions for the respective colors is the same as that in the above-described embodiment but the rotational direction of the belt is opposite to that in the above-described embodiment (i.e., the K image forming portion is disposed in a most upstream side with respect to the rotational direction of the belt). Also in this embodiment, the arrangements of the primary transfer rollers for the colors, the first auxiliary roller and the second auxiliary roller in the operation during the full-color mode and the operation during the monochromatic mode may only be required to be the same as those in the above-described embodiment. However, the K image forming portion may preferably be disposed in the most downstream side or the most upstream side with respect to the rotational direction of the belt from the viewpoint such that the belt can be spaced from the photosensitive drums for the colors in the operation during the monochromatic mode with a relatively simple constitution.

Further, the contact members such as the transfer members provided on the inner peripheral surface of the belt correspondingly to the image bearing members are not limited to the roller-shaped members. The contact members may also be members which are slidable with the rotating belt in contact with the belt and which have, e.g., a block (or pad) shape, a brush shape, a sheet shape, and a blade shape. Also in this case, the belt contacts the contact members for the colors in the operation during the monochromatic mode, so that shortening of lifetimes of the contact members for the colors and unstability of the feedings of the belt can become problematic. Accordingly, the present invention is applied to such a case, so that it is possible to suppress the contact of the belt with the contact members for the colors in the operation during the monochromatic mode.

Further, the auxiliary member and another auxiliary member are not limited to the roller-shaped auxiliary members. When the auxiliary members contact and support the belt and thus are capable of regulating a belt feeding position, the auxiliary members may slide with the belt in contact with the belt. For example, it is possible to use auxiliary members having a block (or pad) shape, a brush shape, a sheet shape, and a rib shape.

Further, the image forming apparatus is not limited to the image forming apparatuses including the four image forming portions for yellow, magenta, cyan and black, but may also be image forming apparatuses including five or more image forming portions or three or less image forming portions. Further, the monochromatic mode is not limited to the case where the black (single color) image is formed, but may also be the case where a single image of any one of the colors is formed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-129121 filed on Jun. 26, 2015, which is hereby incorporated by reference herein in its entirety.

What is claimed is:

1. An image forming apparatus comprising:

a movable endless belt stretched by a plurality of stretching rollers;

a first image bearing member which is provided above said belt at a position opposing said belt and on which a first toner image is formed;

a plurality of second image bearing members which are provided above said belt at positions opposing said belt and on which second toner images are formed, respectively, said second image bearing members being arranged upstream of said first image bearing member with respect to a movement direction of said belt;

a first transfer roller, urged toward said first image bearing member in contact with an inner peripheral surface of said belt, configured to form a first transfer nip;

a plurality of second transfer rollers, urged toward said second image bearing members in contact with the inner peripheral surface of said belt, capable of forming a plurality of second transfer nips, said second transfer rollers being movable in a direction including a vertical direction;

a first auxiliary roller provided in contact with the inner peripheral surface of said belt at a position adjacent to and upstream of a most upstream second transfer roller among said plurality of second transfer rollers with respect to the movement direction of said belt, said first auxiliary roller being movable in the direction including the vertical direction;

a second auxiliary roller provided between said first transfer roller and a most downstream second transfer roller among said plurality of second transfer rollers with respect to the movement direction of said belt, said second auxiliary roller being movable in the direction including the vertical direction;

a first moving mechanism capable of moving said second transfer rollers in the direction including the vertical direction, a second moving mechanism capable of moving said first auxiliary roller in the direction including the vertical direction, and a third moving mechanism capable of moving said second auxiliary roller in the direction including the vertical direction; and an executing portion capable of executing operations in first and second modes, wherein in the operation of the first mode, said second transfer rollers, said first auxiliary roller, and said second auxiliary roller are set in a first arrangement to form the first transfer nip and the second transfer nips and the second toner images and the first toner image are successively transferred from said second image bearing members and said first image bearing member, respectively, onto said belt, and in the operation in the second mode, said second transfer rollers, said first auxiliary roller, and said second auxiliary roller are set in a second arrangement to form the first transfer nip and in a state in which said belt is spaced from said second image bearing members and in which said second transfer rollers are spaced from said belt, and only the first toner image is transferred from said first image bearing member onto said belt to form an image, wherein each of positions of said second transfer rollers and said first auxiliary roller with respect to the vertical direction is lower in the second arrangement than in the first arrangement, and wherein in the second arrangement, in a state in which said first auxiliary roller contacts the inner peripheral surface of said belt, a position of a top of said first auxiliary roller is higher than an uppermost position among positions of tops of said second transfer rollers with respect to the vertical direction.

2. An image forming apparatus according to claim 1, further comprising a displacing source, wherein said executing portion drives said first moving mechanism and said second moving mechanism by said displacing source.

3. An image forming apparatus according to claim 1, wherein when the first arrangement is changed to the second arrangement by said executing portion, a movement amount of each of said second transfer rollers is greater than a movement amount of said first auxiliary roller in the vertical direction.

4. An image forming apparatus according to claim 1, further comprising a displacing source, wherein said executing portion drives said first moving mechanism, said second moving mechanism, and said third moving mechanism by said displacing source.

5. An image forming apparatus according to claim 1, wherein said belt is an elastic belt having an elastic layer.

6. An image forming apparatus according to claim 1, wherein the first transfer nip and the second transfer nips are disposed in a substantially horizontal direction.

7. An image forming apparatus according to claim 1, wherein the stretching rollers include an upstream roller provided upstream and adjacent to said first auxiliary roller with respect to the movement direction of said belt, and wherein with respect to the vertical direction, a position of a top of said upstream roller is lower than a position of a top of said first auxiliary roller in the second arrangement.

8. An image forming apparatus according to claim 6, wherein a position of a top of said first auxiliary roller in the first arrangement is substantially the same as positions of the second transfer nips.

9. An image forming apparatus comprising:

a movable endless belt stretched by a plurality of stretching rollers, the stretching rollers including a tension roller urged from an inner peripheral surface of said belt toward an outer peripheral surface of said belt;

a first image bearing member which is provided above said belt at a position opposing said belt and on which a first toner image is formed;

a plurality of second image bearing members which are provided above said belt at positions opposing said belt and on which second toner images are formed, respectively;

a first transfer roller, urged toward said first image bearing member in contact with the inner peripheral surface of said belt, configured to form a first transfer nip;

a plurality of second transfer rollers, urged toward said second image bearing members in contact with the inner peripheral surface of said belt, capable of forming a plurality of second transfer nips, the second transfer nips being arranged upstream of the first transfer nip with respect to a movement direction of said belt, said second transfer rollers being movable in a direction including a vertical direction;

a first auxiliary roller provided in contact with the inner peripheral surface of said belt at a position adjacent to and upstream of a most upstream second transfer nip among the plurality of second transfer nips with respect to the movement direction of said belt, said first auxiliary roller being movable in the direction including the vertical direction;

a second auxiliary roller contactable with the inner peripheral surface of said belt at a position between the first transfer nip and a most downstream second transfer nip among the plurality of second transfer nips with respect to the movement direction of said belt, said second auxiliary roller being movable in the direction including the vertical direction;

a first moving mechanism capable of moving said second transfer rollers in the direction including the vertical direction, a second moving mechanism capable of moving said first auxiliary roller in the direction including the vertical direction, and a third moving mechanism capable of moving said second auxiliary roller in the direction including the vertical direction; and an executing portion capable of executing operations in first and second modes, wherein in the operation of the first mode, said second transfer rollers, said first auxiliary roller, and said second auxiliary roller are set in a first arrangement to form the first transfer nip and the second transfer nips and the second toner images and the first toner image are successively transferred from said second image bearing members and said first image bearing member, respectively, onto said belt, and in the operation in the second mode, said second transfer rollers, said first auxiliary roller, and said second auxiliary roller are set in a second arrangement to form the first transfer nip and in a state in which said first auxiliary roller and said second auxiliary roller contact the inner peripheral surface of said belt, and in which said belt is spaced from said second image bearing members and in which said second transfer rollers are spaced from said belt, and only the first toner image is transferred from said first image bearing member onto said belt to form an image, wherein each of positions of said second transfer rollers and said first auxiliary roller with respect to the vertical direction is lower in the second arrangement than in the first arrangement, and wherein in the second arrangement, in a state in which said first auxiliary roller contacts the inner peripheral surface of said belt, a position of a top of said first auxiliary roller is higher than an uppermost position among positions of tops of said second transfer rollers with respect to the vertical direction.

10. An image forming apparatus according to claim 9, further comprising a displacing source, wherein said executing portion drives said first moving mechanism and said second moving mechanism by said displacing source.

11. An image forming apparatus according to claim 9, wherein when the first arrangement is changed to the second arrangement by said executing portion, a movement amount of each of said second transfer rollers is greater than a movement amount of said first auxiliary roller in the vertical direction.

12. An image forming apparatus according to claim 9, further comprising a displacing source, wherein said executing portion drives said first moving mechanism, said second moving mechanism, and said third moving mechanism by said displacing source.

13. An image forming apparatus according to claim 9, wherein said belt is an elastic belt having an elastic layer.

14. An image forming apparatus according to claim 9, wherein the first transfer nip and the second transfer nips are disposed in a substantially horizontal direction.

15. An image forming apparatus according to claim 9, wherein the stretching rollers include an upstream roller provided upstream and adjacent to said first auxiliary roller with respect to the movement direction of said belt, and wherein with respect to the vertical direction, a position of a top of said upstream roller is lower than a position of a top of said first auxiliary roller in the second arrangement.

16. An image forming apparatus according to claim 14, wherein a position of a top of said first auxiliary roller in the first arrangement is substantially the same as positions of the second transfer nips.

17. An image forming apparatus according to claim 9, wherein said second auxiliary roller is spaced from said belt in the first arrangement.

18. An image forming apparatus according to claim 1, wherein said second auxiliary roller is spaced from said belt in the first arrangement.

* * * * *